US005118469A

United States Patent [19]

Abe et al.

[11] Patent Number: 5,118,469

[45] Date of Patent: Jun. 2, 1992

[54] HIGH STRENGTH SPRING STEEL

[75] Inventors: Tsuyoshi Abe, Chiba; Nobumasa Umezawa, Funabashi; Tatsuo Fukuzumi, Tokyo; Katsuyuki Uchibori, Chiba, all of Japan

[73] Assignee: Mitsubishi Steel Mfg. Co., Ltd., Tokyo, Japan

[21] Appl. No.: 720,722

[22] Filed: Jun. 25, 1991

[30] Foreign Application Priority Data

Oct. 22, 1990 [JP] Japan ..... 2-281915

[51] Int. Cl.[5] ..... C22C 38/44; C22C 38/48

[52] U.S. Cl. ..... 420/109; 148/908

[58] Field of Search ..... 420/109, 112, 108, 109; 148/908

[56] References Cited

U.S. PATENT DOCUMENTS 4,448,617 5/1984 Yamamoto et al. ..... 420/106
4,544,406 10/1985 Yamamoto et al. ..... 420/109
4,574,016 3/1986 Yamamoto et al. ..... 148/144
4,770,721 9/1988 Yamamoto et al. ..... 148/144
4,842,818 6/1989 Kato et al. ..... 420/100
5,009,843 4/1991 Sugimoto et al. ..... 420/109
4,7112,675 12/1987 Yamamoto et al. ..... 148/144

OTHER PUBLICATIONS

"Sag Resistance of Si-Mo and Si-Cr Spring Steels," SAE Technical Paper Series, F. Borik et al., Society of Automotive Engineers, Inc., pp. 1-8 and title page.

*Primary Examiner*—Deborah Yee
*Attorney, Agent, or Firm*—Flynn, Thiel, Boutell & Tanis

[57] ABSTRACT

Disclosed is a high strength spring steel consisting of, in weight percentage, 0.40 to 0.70% C, 0.50 to 2.00% Si, more than 0.50 to 1.50% Mn, 0.50 to 2.50% Ni, 0.20 to 1.50% Cr, more than 0.60 to 1.50% Mo, 0.01 to 0.50% V, 0.01 to 0.50% Nb, 0.005 to 0.100% Al and the balance being Fe and unavoidable impurities. The steel of the present invention has a high hardness coupled with high toughness and is very useful especially for springs used in suspension devices or other various industrial machines.

4 Claims, No Drawings

HIGH STRENGTH SPRING STEEL

BACKGROUND OF THE INVENTION

1. Field of the Invention

This invention relates to a high strength spring steel useful in cars, aircraft, various industrial machines, etc.

2. Description of the Prior Art

In recent years, weight saving has been strongly demanded in cars for saving the cost of fuel. The same demand has also been growing in various structural parts or members including suspension devices. One possible approach for reducing the weight of suspension devices is to provide suspension springs with a high design stress. Strengthening the springs is effective as a weight-saving measure. Currently, Si-Mn type steel, designated SUP 7, and Si-Cr type steel, designated SUP 12, are mainly used as steel stock for suspension springs. In order to increase the design stress of these known spring steels, it is necessary to strengthen them. In general, the strength of steel materials is closely correlated with their hardness. On the other hand, there is the problem that when the hardness of the spring steels is increased, the toughness of the same is reduced, that is, reduction of the toughness is unavoidable in obtaining a hardness higher than that may be achieved in spring steels in current use. In order to ensure a sufficient reliability in spring steels, not only the hardness but also the toughness must be higher than those of currently available steels.

SUMMARY OF THE INVENTION

It is an object of the present invention to provide a high strength spring steel which has higher strength and toughness than spring steels currently used.

The influences of various elements on the hardness and toughness of spring steels were studied by the present inventors and the following relationship was found.

$$Hv = 528.284 + 140.655(C\ \%) + 33.334(Si\ \%) - 31.860(Mn\ \%) - 4.349(Ni\ \%) - 11.359(Cr\ \%) + 24.631(Mo\ \%) + 17.306(V\ \%) + 138.631(Nb\ \%) + 356.040(Al\ \%)$$ (multiple correlation coefficient R = 0.970).

Charpy impact value $Cp(kgf\text{-}m/cm^2) = 5.951 - 7.726(C\ \%) + 0.633(Si\ \%) + 0.371(Mn\ \%) + 0.123(Ni\ \%) + 0.624(Cr\ \%) + 1.581(Mo\ \%) - 5.357(V\ \%) + 25.386(Nb\ \%) - 12.453(Al\ \%)$ (multiple correlation coefficient R = 0.955)

Percentages (%) of the respective elements shown in the above equations are by weight.

The above relations are applicable to a steel which has been subjected to a sufficient martensitic transformation by quenching and then tempering at 350°0 C.

From the above result, it has been found that there are very good relationships between certain alloying elements and properties of hardness and toughness (in terms of Charpy impact value). In detail, alloying elements C, Si, Mo, V, Nb and Al should be controlled to certain amounts in order to obtain a hardness level. On the other hand, for high Charpy impact values, alloying elements of Si, Mn, Ni, Cr, Mo and Nb should be controlled to certain content levels. By controlling these alloying elements, there can be obtained high-strength spring steels having both high hardness and high toughness.

According to the present invention, there is provided a high strength spring steel consisting of, in weight percentage, 0.40 to 0.70% C, 0.50 to 2.00% Si, more than 0.50 to 1.50% Mn, 0.50 to not more than 2.50% Ni, 0.20 to 1.50% Cr, more than 0.60 to not more than 1.50% Mo, 0.01 to 0.50% V, 0.01 to 0.50% Nb, 0.005 to 0.100% Al and the balance being Fe and unavoidable impurities.

The components of the steel of the present invention are specified as above for the following reasons.

Carbon: C is an effective element to increase the strength of the steel. When its content is less than 0.40%, a strength adequate for springs can not be obtained. On the other hand, when carbon is present in excess of 0.70%, the resulting springs becomes too brittle. Therefore, the carbon content is limited to the range of 0.40 to 0.70%.

Silicon: Si dissolves in ferrite to form a solid solution and effectively acts in the improvement of the strength of the steel. When the Si content is less than 0.50%, a strength sufficient for preparation of springs can not be ensured. An excessive content of Si of more than 2.00% tends to cause a decarburization problem on the steel surface during the hot-forming the steel into a spring and hence to detrimentally affect the durability of the springs. Therefore, the content of Si is limited to the range of 0.50 to 2.00%.

Manganese: Mn is an element that is effective to improve the hardenability of the steel and, for this effect, more than 0.50% is needed. However, when Mn is present in excess of 1.50%, the toughness is adversely affected. Therefore, the Mn content is limited to the range of more than 0.50% to not more than 1.50%.

Nickel: Ni also has an effect in improving the hardenability of the steel and at least 0.50% is needed. However, an excessive amount of Ni more than 2.50% results in an unacceptably high level of retained austenite in the springs after hardening and tempering and the fatigue strength of the springs is adversely affected. Therefore, the Ni content is limited to the range of 0.50 to 2.50%.

Chromium: Cr is effective to strengthen the steel. However, when the Cr content is less than 0.20%, a strength adequate for springs can not be obtained. On the other hand, an amount above 1.50% results in a deterioration in toughness. Therefore, the Cr content is limited to the range of 0.20 to 1.50%.

Molybdenum: Mo is an element which is required to ensure a sufficient hardenability and increase the strength and toughness of the steel. An amount of Mo of 0.60% or less can not sufficiently provide this effect, while an amount above 1.50% tends to cause precipitation of coarse carbides, which impair the spring properties. Therefore, the Mo content is limited to the range of more than 0.60% to not more than 1.50%.

Vanadium: V also strengthens the steel. However, when the V content is less than 0.01%, a sufficient strengthening effect can not be obtained. On the other hand, when the V content exceeds 0.50%, a substantial amount of carbides may not dissolve into the austenite and, thereby, the spring characteristics are impaired. Thus, the V content range is limited to the range of 0.01 to 0.50%.

Niobium: Nb is an element which increases the strength and toughness of the steel due to its grain-refinement function and precipitation effect of fine carbides. When the content is less than 0.01%, the effect is not sufficiently obtained. On the other hand, when Nb is present in excess of 0.50%, the amount of carbides which do not dissolve into austenite increases and the spring characteristics are impaired. Accordingly, the content of Nb should be in the range of 0.01 to 0.50%.

Aluminum: Al is needed for deoxidation and control of the austenite grain size. When Al is present in amounts less than 0.005%, grain refinement can not be expected. On the other hand, an excessive amount of Al above 0.100% tends to reduce the alloys castability. Thus, the content of Al should be in the range of 0.005 to 0.100%.

The spring steel of the present invention having the composition as specified above can be obtained through commonly practiced production steps, such as steel-making; ingot-making or continuous casting; and blooming and rolling into a steel bar or wire rod. Thereafter, the steel is hot-formed into a coil spring and is subjected to aftertreatments, such as quenching, tempering, shot-peening and setting. In such a production process, a high strength coil spring can be obtained.

EXAMPLE

Table 1 shows the relationship between the chemical composition and the mechanical properties, that is, hardness and Charpy impact value, for the test sample of each steel after quenching and tempering at 350° C. It can be seen that the steels of the present invention have higher Charpy impact values than conventional steels and comparative steels.

TABLE 1

| | Chemical Composition (wt. %) | | | | | | | | | | | Mechanical Properties | |
|---|---|---|---|---|---|---|---|---|---|---|---|---|---|
| | | | | | | | | | | | | Hardness | Charpy Impact Values |
| No. | C | Si | Mn | Ni | Cr | Mo | V | Nb | Al | P | S | (Hv) | (kgf-m/cm²) |
| 1 | 0.63 | 0.67 | 1.06 | 0.01 | 0.26 | 0.20 | — | — | 0.015 | 0.006 | 0.005 | 614 | 2.0 |
| 2 | 0.64 | 0.59 | 1.03 | 0.01 | 0.26 | 0.20 | 0.10 | 0.022 | 0.017 | 0.006 | 0.005 | 600 | 2.7 |
| 3 | 0.61 | 1.43 | 0.93 | 0.01 | 0.02 | 0.20 | — | — | 0.034 | 0.005 | 0.005 | 649 | 1.9 |
| 4 | 0.61 | 1.37 | 0.92 | 0.01 | 0.01 | 0.20 | 0.10 | 0.023 | 0.020 | 0.005 | 0.005 | 654 | 2.5 |
| 5 | 0.62 | 0.13 | 1.49 | 0.01 | 0.99 | 0.30 | — | — | 0.021 | 0.008 | 0.006 | 574 | 2.6 |
| 6 | 0.63 | 0.16 | 1.54 | 0.01 | 1.01 | 0.30 | 0.10 | 0.024 | 0.013 | 0.008 | 0.006 | 582 | 2.7 |
| 7 | 0.63 | 0.19 | 2.09 | 0.02 | 0.02 | 0.30 | — | — | 0.015 | 0.008 | 0.006 | 561 | 2.1 |
| 8 | 0.63 | 0.20 | 2.07 | 0.01 | 0.01 | 0.30 | 0.10 | 0.025 | 0.018 | 0.008 | 0.005 | 563 | 2.7 |
| 9 | 0.65 | 1.75 | 0.82 | 0.01 | 0.15 | 0.01 | 0.20 | 0.066 | 0.066 | 0.005 | 0.005 | 682 | 2.3 |
| 10 | 0.60 | 0.99 | 1.40 | 0.02 | 0.28 | 0.20 | 0.15 | 0.024 | 0.030 | 0.007 | 0.002 | 631 | 1.8 |
| 11 | 0.57 | 1.50 | 0.77 | 0.01 | 0.72 | 0.01 | — | — | 0.037 | 0.005 | 0.006 | 620 | 2.8 |
| 12 | 0.57 | 1.53 | 0.80 | 0.02 | 0.73 | 0.01 | 0.19 | 0.022 | 0.024 | 0.005 | 0.006 | 630 | 2.7 |
| 13 | 0.65 | 1.81 | 0.82 | 0.01 | 0.05 | 0.01 | — | — | 0.021 | 0.005 | 0.004 | 650 | 2.5 |
| 14 | 0.52 | 0.82 | 0.61 | 2.06 | 1.01 | 0.40 | 0.13 | — | 0.019 | 0.005 | 0.006 | 603 | 2.7 |
| 15 | 0.52 | 0.77 | 0.61 | 2.05 | 1.01 | 0.61 | 0.11 | — | 0.024 | 0.005 | 0.005 | 600 | 4.1 |
| 16 | 0.51 | 0.81 | 0.61 | 2.06 | 0.98 | 0.84 | 0.11 | — | 0.021 | 0.005 | 0.005 | 608 | 4.2 |
| 17 | 0.52 | 1.00 | 0.63 | 1.85 | 0.86 | 0.65 | 0.11 | — | 0.014 | 0.005 | 0.006 | 620 | 4.3 |
| 18 | 0.48 | 0.88 | 0.61 | 1.01 | 0.99 | 0.71 | — | 0.022 | 0.025 | 0.005 | 0.005 | 614 | 5.5 |
| 19 | 0.47 | 0.74 | 0.60 | 1.50 | 0.99 | 0.71 | — | 0.025 | 0.008 | 0.005 | 0.005 | 605 | 5.3 |
| 20 | 0.50 | 1.08 | 0.66 | 2.33 | 0.93 | 0.86 | 0.10 | — | 0.045 | 0.010 | 0.010 | 624 | 4.3 |
| 21 | 0.52 | 0.96 | 0.59 | 1.00 | 0.98 | 0.70 | 0.10 | 0.026 | 0.019 | 0.010 | 0.005 | 624 | 4.8 |
| 22 | 0.52 | 0.95 | 0.59 | 1.89 | 0.98 | 0.87 | 0.09 | 0.028 | 0.018 | 0.010 | 0.005 | 620 | 4.2 |
| 23 | 0.55 | 0.84 | 0.71 | 0.53 | 1.03 | 0.88 | 0.20 | 0.037 | 0.050 | 0.005 | 0.006 | 642 | 4.0 |
| 24 | 0.51 | 0.92 | 0.71 | 0.71 | 1.03 | 0.90 | 0.20 | 0.038 | 0.038 | 0.005 | 0.006 | 621 | 4.3 |
| 25 | 0.57 | 0.95 | 0.69 | 0.53 | 1.02 | 0.92 | 0.19 | 0.043 | 0.025 | 0.005 | 0.006 | 636 | 4.1 |
| 26 | 0.51 | 1.56 | 0.65 | 1.03 | 0.99 | 0.69 | 0.11 | 0.026 | 0.043 | 0.006 | 0.005 | 652 | 5.0 |
| 27 | 0.50 | 1.48 | 0.66 | 1.59 | 0.97 | 0.79 | 0.01 | 0.026 | 0.033 | 0.006 | 0.005 | 637 | 5.2 |

Remark:
Nos. 15-27: Steels of the present Invention
Nos. 1-10, 12 and 14: Comparative Steels
Nos. 11 and 13: Conventional Steels
P and S: Impurities Steel ingots were prepared from the inventive steel No. 22 and the conventional steel No. 11, hot-rolled to effect a reduction ratio of at least 50, and hot-formed into coil springs. The resulting coil springs were subjected to quenching, tempering, shot-peening and setting. Table 2 shows particulars of the coil springs. The hardness values of the springs were adjusted to Hv 620 for the inventive steel and Hv 530 for the conventional steel.

TABLE 2

| | |
|---|---|
| Diameter of wire | 11.5 mm |
| Mean diameter of coil | 115 mm |
| Total No. of turns | 5.5 |
| No. of active turns | 4.0 |

Each spring was subjected to a fatigue test by being was subjected to cyclic stress application as specified in Table 3. The test was conducted on six test springs prepared from each of the inventive steel and the conventional steel and the results are shown in Table 3. It will be seen from Table 3, that the steel of the present invention can guarantee a long useful life equivalent to that of conventional steel, even if the steel of the present invention is placed under a higher stress condition that of conventional spring steel.

TABLE 3

| | Applied Stress (kgf/mm²) | Number of Cycles to Failure (× 10⁴) |
|---|---|---|
| Steel of the Invention | 10-130 | 14.3, 17.7, 18.1, 20.6, 22.8, 26.1 |
| Conventional Steel | 10-110 | 15.6, 16.4, 20.2, 21.7, 25.2, 25.7 |

Table 4 shows the results of a sag test for the coil springs prepared from the inventive steel No. 22 and the conventional steel No. 11. The test results show that the inventive steel spring can ensure a high settling resistance which is equivalent to that of the conventional steel, even if it is placed in a higher stress condition than the conventional steel. In other words, the steel of the present invention is a high strength spring steel which can be formed into springs to be used under stress higher than that may be applied to the conventional spring steel. In the steel of the present invention, it is possible to increase the strength or hardness to a much higher level than heretofore available while maintaining the Charpy impact value at a high level. Therefore, a high reliability can be ensured in the resulting spring products.

TABLE 4

| | Applied Stress ($kgf/mm^2$) | Residual Shear Strain |
|---|---|---|
| Steel of the Invention | 130 | $6.6 \times 10^{-4}$ |
| Conventional Steel | 110 | $6.3 \times 10^{-4}$ |

Remark:
Test Conditions. 80° C. ×. 96 hours

As described above, the steel of the present invention is a high strength spring steel and, when it is used for preparation of springs, a long useful life and a high settling resistance can be ensured. Accordingly, the inventive steel produces outstanding effects in practical services in various industrial machines.

We claim:

1. A high strength spring steel consisting of, in weight percentage, 0.40 to 0.70% C, 0.50 to 2.00% Si, more than 0.50 to 1.50% Mn, 0.50 to 2.50% Ni, 0.20 to 1.50% Cr, more than 0.60 to 1.50% Mo, 0.01 to 0.50% V, 0.01 to 0.50% Nb, 0.005 to 0.100% Al and the balance being Fe and unavoidable impurities.

2. The high strength spring steel of claim 1 consisting of, in weight percentage, 0.52% C, 0.95% Si, 0.59% Mn, 1.89% Ni, 0.98% Cr, 0.87% Mo, 0.09% V, 0.28% Nb, 0.018% Al and the balance being Fe and unavoidable impurities.

3. The high strength spring steel of claim 1 consisting of, in weight percentage, 0.51% C, 1.56% Si, 0.65% Mn, 1.03% Ni, 0.99% Cr, 0.69% Mo, 0.11% V, 0.26% Nb, 0.043% Al and the balance being Fe and unavoidable impurities.

4. The high strength spring steel of claim 1 consisting of, in weight percentage, 0.50% C, 1.48% Si, 0.66% Mn, 1.59% Ni, 0.97% Cr, 0.79% Mo, 0.10% V, 0.26% Nb, 0.033% Al and the balance being Fe and unavoidable impurities.

* * * * *

UNITED STATES PATENT AND TRADEMARK OFFICE

CERTIFICATE OF CORRECTION

PATENT NO. : 5 118 469

DATED : June 2, 1992

INVENTOR(S) : Tsuyoshi ABE et al.

It is certified that error appears in the above-identified patent and that said Letters Patent is hereby corrected as shown below:

Column 6, line 20; change "0.26%" to ---0.026%---.

Signed and Sealed this

Fifth Day of October, 1993

Bruce Lehman

*Attest:*

BRUCE LEHMAN

*Attesting Officer*

*Commissioner of Patents and Trademarks*